US008163133B2

(12) United States Patent
Krückel

(10) Patent No.: US 8,163,133 B2
(45) Date of Patent: Apr. 24, 2012

(54) DISPERSION

(75) Inventor: Ralf Krückel, Langerwehe (DE)

(73) Assignee: Akzo Nobel N.V., Arnhem (NL)

( * ) Notice: Subject to any disclaimer, the term of this patent is extended or adjusted under 35 U.S.C. 154(b) by 357 days.

(21) Appl. No.: 10/811,133

(22) Filed: Mar. 26, 2004

(65) Prior Publication Data

US 2004/0206274 A1 Oct. 21, 2004

Related U.S. Application Data

(60) Provisional application No. 60/459,318, filed on Apr. 1, 2003.

(51) Int. Cl.

| | |
|---|---|
| ***D21H 17/17*** | (2006.01) |
| ***D21H 17/34*** | (2006.01) |
| ***D21H 21/16*** | (2006.01) |
| ***D21H 23/04*** | (2006.01) |
| ***D21H 23/22*** | (2006.01) |

(52) U.S. Cl. ..... 162/168.1; 162/135; 162/158; 162/184; 162/185; 549/329

(58) Field of Classification Search ..... 162/135, 162/184, 185, 158, 168.1, 168.7; 549/329; 106/164.4, 287.2, 287.24
See application file for complete search history.

(56) References Cited

U.S. PATENT DOCUMENTS

| | | | | |
|---|---|---|---|---|
| 4,051,093 | A * | 9/1977 | Wendel et al. | 524/812 |
| 4,214,948 | A | 7/1980 | Mazzarella et al. | 162/158 |
| 4,529,447 | A | 7/1985 | Okada et al. | 106/287.24 |
| 5,498,648 | A | 3/1996 | de Clercq et al. | 524/47 |
| 5,942,588 | A * | 8/1999 | Ettl et al. | 526/316 |
| 5,969,011 | A | 10/1999 | Frölich et al. | 524/35 |
| 6,162,328 | A | 12/2000 | Cenisio et al. | 162/135 |
| 6,306,255 | B1 * | 10/2001 | Frolich et al. | 162/158 |
| 6,426,381 | B1 | 7/2002 | König et al. | 524/734 |
| 6,692,560 | B2 * | 2/2004 | Holmberg et al. | 106/287.2 |
| 2002/0100567 | A1 | 8/2002 | Lindgren et al. | 162/168.1 |
| 2003/0019599 | A1 | 1/2003 | Nicholass et al. | 162/158 |

FOREIGN PATENT DOCUMENTS

| | | |
|---|---|---|
| EP | 0151646 | 8/1985 |
| JP | 11-043894 | 2/1999 |
| WO | WO 97/31152 | 8/1997 |
| WO | 02/090653 A2 | 11/2002 |

OTHER PUBLICATIONS

Reynolds, Walter F., "The Sizing of Paper," Second Edition (1989) Tappi Press, pp. 36-38.

* cited by examiner

*Primary Examiner* — Matthew Daniels
*Assistant Examiner* — Dennis Cordray
(74) *Attorney, Agent, or Firm* — Robert C. Morriss

(57) ABSTRACT

The invention relates to an aqueous dispersion useful for internal sizing or surface sizing in the production of paper, comprising at least one cellulose reactive sizing agent selected from the group consisting of ketene dimers and multimers, at least one cellulose non-reactive sizing agent and at least one emulsifier selected from the group consisting of oxyalkylene phosphate and sulfate esters and salts thereof. The invention further concerns a process for its preparation, use thereof, and processes for the production of paper.

8 Claims, No Drawings

DISPERSION

This application claims priority based on U.S. Provisional Patent Application No. 60/459,318, filed Apr. 1, 2003.

The present invention relates to an aqueous dispersion comprising a cellulose reactive sizing agent, a cellulose non-reactive sizing agent and an emulsifier, its preparation, and use thereof in paper making.

Cellulose reactive sizes, such as those based on alkyl ketene dimer (AKD) and alkenyl succinic anhydride (ASA), are widely used for internal sizing in papermaking. They generally provide good internal sizing even in low dosages. However, it has been experienced that under some circumstances the efficiency of conventional cellulose reactive sizing agents is not fully satisfactory, for example when used with stocks having a high cationic demand and containing substantial amounts of lipophilic wood extractives, such as resin acids, fatty acids, fatty esters, triglycerides, etc.

It has also been suggested to use cellulose reactive sizing agents for surface sizing, but it has been found that they may cause problems with size reversion, toner adhesion and high speed paper converting.

Cellulose non-reactive sizes have so far mainly been used for surface sizing. Examples of such materials are starch and other polymeric sizes such as copolymers of styrene with vinyl monomers such as maleic anhydride, acrylic acid and its alkyl esters, acrylamide, etc. Cellulose non-reactive sizes generally exhibit improved toner adhesion, little or no effect on coefficient of friction, no effect, or an improved effect on high speed converting, and no size reversion when compared to reactive sizes. However, they are less efficient at sizing than the cellulose reactive sizes.

Cellulose reactive sizes are generally provided in the form of dispersions containing an aqueous phase and finely divided particles or droplets of the sizing agent dispersed therein. The dispersions are usually prepared with the aid of a dispersant system consisting of an anionic compound, e.g. sodium lignosulfonate, in combination with a high molecular weight amphoteric or cationic polymer, e.g. cationic starch, polyamine, polyamide amine or a vinyl addition polymer. Depending on the overall charge of the compounds of the dispersant system, the size dispersions will be cationic or anionic in nature.

U.S. Pat. No. 5,969,011 discloses an improved aqueous dispersion of a cellulose reactive sizing agent dispersed in the aqueous phase by means of a dispersant system comprising a low molecular weight cationic organic compound and an anionic stabilizer.

WO 02/090653 discloses a sizing composition comprising a sizing agent, a non-ionic surfactant, an anionic surfactant and a monohydric alcohol.

U.S. Pat. No. 4,529,447 discloses a sizing composition comprising a carboxylic acid anhydride and a polyoxyalkylene non-ionic surfactant blocked with a lower alkyl, acyl or carbamoyl group and/or an alkaline earth metal salt of a sulfur-containing anionic surfactant.

EP-A1-151646 discloses a sizing agent composition based on alkyl-succinic anhydride.

U.S. Pat. No. 5,498,648 discloses a paper size mixture prepared by mixing a suspension of cationic starch with a polymer dispersion and emulsifying a alkyldiketene in this mixture. However, such formulations are predominantly cationic and have been found to interfere with anionic components used in paper making, particularly optical brightening agents.

U.S. Pat. No. 6,162,328 discloses a process for the production of paper in which cellulose reactive size that is not solid at 25° C. and a cellulose non-reactive size that is a polymer of weight average molecular weight greater than about 1500 are applied to paper obtained by sheeting and drying an aqueous pulp suspension. However, it has been found difficult to provide dispersions of high stability comprising both a cellulose reactive size and a cellulose non-reactive size, particularly for anionic dispersions.

It is an object of the invention to provide a dispersion of high stability comprising a cellulose reactive sizing agent.

It is another object of the invention to provide a dispersion comprising a cellulose reactive sizing agent and a cellulose non-reactive sizing agent.

It is still another object of the invention to provide a size of high efficiency for internal sizing.

It is a further object of the invention to provide a size of high efficiency for surface sizing.

It has surprisingly been found possible to obtain stable dispersions of cellulose reactive and cellulose non-reactive sizing agents by using a certain kind of emulsifier. Thus, the invention concerns an aqueous dispersion useful for internal sizing or surface sizing in the production of paper, comprising at least one cellulose reactive sizing agent selected from the group consisting of ketene dimers and multimers, at least one cellulose non-reactive sizing agent, and at least one emulsifier selected from the group consisting of oxyalkylene phosphate and sulfate esters (the latter also being called oxyalkylene sulfonates), and salts thereof, of which oxyalkylene phosphate esters and salts thereof are most preferred.

The weight ratio between the cellulose reactive sizing agent and the cellulose non-reactive sizing agent is preferably from about 1:99 to about 99:1, most preferably from about 1:9 to about 9:1. In a dispersion for internal sizing, suitable for being added to a stock containing cellulosic fibers, the weight ratio preferably Is from about 0,4:1 to about 99:1, most preferably from about 1:1 to about 9:1, while in a dispersion for surface sizing, suitable for being added to a paper web, the weight ratio preferably is from about 1:99 to about 1:1, most preferably from about 1:9 to about 1:1.5.

Preferably, the dispersion also comprises at least one cationic organic compound having a weight average molecular weight less than about 10000 or at least one anionic stabilizer, or both, which is most preferred.

In the most preferred embodiment the dispersion thus comprises a cellulose reactive sizing agent selected from the group consisting of ketene dimers and multimers, a cellulose non-reactive sizing agent and a dispersing system comprising an emulsifier selected from the group consisting of oxyalkylene phosphate and sulfate esters and salts thereof, a cationic organic compound having a weight average molecular weight less than about 10000 and an anionic stabilizer.

The amount of ketene dimers and multimers in the dispersion is preferably from about 0.1 to about 50 wt %, most preferably from about 0.5 to about 50 wt %. Preferably at least one hydrophobic ketene dimer is present. Preferred ketene dimers have the general formula:

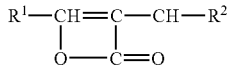

where $R^1$ and $R^2$ represent the same or different saturated or unsaturated hydrocarbon groups such as alkyl, alkenyl, cycloalkyl, aryl or aralkyl. The hydrocarbon groups preferably have from 6 to 36 carbon atoms, most preferably from 12 to 20 carbon atoms. Examples of hydrocarbon groups include octyl, decyl, dodecyl, tetradecyl, hexadecyl, octadecyl, eicosyl, docosyl, tetracosyl, phenyl, benzyl, beta-naphthyl, cyclohexyl and hexadecyl groups. Preferred hydrocarbon groups are straight or branched chain alkyl groups, such as hexadecyl and octadecyl groups. Useful ketene dimers also include those prepared from organic acids such as montanic acid, naphthenic acid, 9,10-decylenic acid, 9,10-dodecylenic acid, palmitoleic acid, oleic acid, ricinoleic acid, linoleic acid, eleostearic acid, naturally occurring mixtures of fatty acids found in coconut oil, babassu oil, palm kernel oil, palm oil, olive oil, peanut oil, rape oil, beef tallow, lard, whale blubber, and mixtures of any of the above named fatty acids with each other.

The amount of emulsifier selected from oxyalkylene phosphate and sulfate esters and salts thereof in the dispersion is preferably from about 0.01 to about 10 wt %, most preferably from about 0.1 to about 5 wt %. Preferred phosphate and sulfate esters fall under the formula:

$$R^3\text{-}A^1\text{-}O\text{-}Q\text{-}R^4$$

where $R^4$ is —OH or —O-$A^2$-$R^5$;

$A^1$ and $A^2$, independently of each others, are oxyalkylene chains, preferably with from 2 to 100 oxyalkylene units, most preferably with from 3 to 50 oxyalkylene units, particularly most preferably with from 5 to 20 oxyalkylene units;

Q is PO(OH) or $SO_2$, of which PO(OH) is preferred; and, $R^3$ and $R^5$, independently of each others, are hydrocarbon groups, preferably having from 3 to 50 carbon atoms, most preferably from 8 to 20 carbon atoms.

The hydrocarbon groups may, for example, be alkyl, alkenyl, cycloalkyl, aryl or aralkyl, of which aliphatic groups and particularly alkyl groups are preferred. The oxyalkylene chains preferably consist of oxyethylene units, oxypropylene units or a mixture thereof, of which pure oxyethylene chains are most preferred. The most preferred emulsifiers belong to the group of aliphatic mono and di (polyoxyethylene alkyl) phosphate esters having one or two oxyethylene chains each comprising from 5 to 15 moles ethylene oxide and where the alkyl group(s) have from 10 to 15 carbon atoms. Examples of such polyoxyethylene alkyl phosphate esters include ethoxylated tridecyl phosphate esters. Most preferably a mixture of mono and di (polyoxyalkylene alkyl) esters of phosphate is used.

As already stated, the emulsifier may also be one or more salt of compounds as described above, preferably ammonium or alkali metal salts, such as sodium or potassium salts, but also salts of other metals such as magnesium or calcium are possible.

If a cationic organic compound having a weight average molecular weight less than about 10000 is present, the amount thereof in the dispersion is preferably from about 0.01 to about 5 wt %, most preferably from about 0.1 to about 2 wt %. The cationic organic compound preferably contains one or more cationic groups of the same or different types and most preferably include cationic compounds having one cationic group and cationic compounds having two or more cationic groups, i.e. cationic polyelectrolytes. Examples of suitable cationic groups include sulfonium groups, phosphonium groups, acid addition salts of primary, secondary and tertiary amines or amino groups and quaternary ammonium groups, for example where the nitrogen has been quaternized with methyl chloride, dimethyl sulfate or benzyl chloride, preferably acid addition salts of amines/amino groups and quaternary ammonium groups. Cationic polyelectrolytes can have a degree of substitution ($DS_c$) varying over a wide range, for example from about 0.01 to about 1.0, preferably from about 0.1 to about 0.8 and most preferably from about 0.2 to about 0.6.

Suitable cationic organic compounds for use in this invention include cationic compounds capable of functioning as a surfactant and/or dispersing agent and/or coupling agent between particles or droplets of a sizing agent and/or an anionic stabilizer. Preferably the cationic organic compound is a surfactant. Preferred cationic surfactants include compounds having the general formula $R_4N^+X^-$, wherein each R group, independently of each other, is hydrogen or a hydrocarbon group having from 1 to 30 carbon atoms, preferably from 1 to 22 carbon atoms. The hydrocarbon groups are suitably aliphatic and preferably alkyl groups, and may be interrupted by one or more heteroatoms, e.g. oxygen or nitrogen, and/or groups containing a heteroatom, e.g. carbonyl and acyloxy groups. At least one, suitably at least three and preferably all of said R groups contain carbon atoms. Suitably at least one and preferably at least two of said R groups containing at least 7 carbon atoms, preferably at least 9 carbon atoms and most preferably at least 12 carbon atoms. X is an anion, suitably a halide like chloride, or an anionic group present in an anionic compound of the dispersion, e.g. where the surfactant is a protonated amine of the formula $R_3NH^*$ where R is as defined above. Examples of suitable surfactants include dioctyldimethylammonium chloride, didecyldimethylammonium chloride, dicocodimethylammonium chloride, cocobenzyldimethylammonium chloride, coco(fractionated) benzyldimethylammonium chloride, octadecyl trimethylammonium chloride, dioctadecyl dimethylammonium chloride, dihexadecyl dimethylammonium chloride, di(hydrogenated tallow)dimethylammonium chloride, di(hydrogenated tallow)benzylmethylammonium chloride, (hydrogenated tallow)benzyldimethylammonium chloride, dioleyldimethylammonium chloride, and di(ethylene hexadecanecarboxylate)dimethylammonium chloride. Particularly preferred cationic surfactants thus include those containing at least one hydrocarbon group with from 9 to 30 carbon atoms and notably quaternary ammonium compounds.

Useful cationic polyelectrolytes also include low molecular weight cationic organic polymers, optionally degraded, e.g. those derived from polysaccharides like starches and guar gums, cationic condensation products like cationic polyurethanes, polyamideamines, e.g. poly-amideamine-epichlorohydrin copolymers, polyamines, e.g. dimethylamine-epichlorohydrin copolymers, dimethylamine-ethylenediamine-epichlorohydrin copolymers, ammonia-ethylenendichloride copolymers, vinyl addition polymers formed from monomers with cationic groups, e.g. homopolymers and copolymers of diallyldimethylammonium chloride, dialkyl-aminoalkyl acrylates, methacrylates and acrylamides (e.g. dimethylaminoethyl acrylates and methacrylates) which usually are present as acid addition salts or quaternary ammonium salts, optionally copolymerized with non-ionic monomers including acrylamide, alkyl acrylates, styrene and acrylonitrile and derivatives of such monomers, vinyl esters, and the like.

The weight average molecular weight of the cationic organic compound generally can be up to about 10000, usually up to about 5000, suitably up to about 3000 and preferably up to about 800, and most preferably at least about 200. Suitable cationic surfactants preferably have a weight average molecular weight up to about 3000, most preferably from about 200 to about 800.

If an anionic stabilizer is present, the amount thereof in the dispersion is preferably from about 0.01 to about 5 wt %, most preferably from about 0.1 to about 3 wt %. Suitable anionic stabilizers for use in this invention include anionic compounds functioning as stabilizers and/or being effective in combination with a cationic organic compound as described above to stabilise the sizing agent in an aqueous phase as well as anionic compounds known as useful as dispersants in the preparation of size dispersions. Preferably the anionic compound is water-soluble or water-dispersable. The anionic stabilizer can be can be selected from organic or inorganic compounds and can be derived from natural or synthetic sources. The anionic stabilizer of the dispersant system contains one or more anionic groups of the same or different types and include anionic compounds having one anionic group and anionic compounds having two or more anionic groups, herein referred to as an anionic polyelectrolyte. The term anionic polyelectrolyte is meant to include also anionic compounds acting as a polyelectrolyte, e.g. through chemical non-ionic interaction or attraction. In a preferred embodiment, the anionic stabilizer is an anionic polyelectrolyte. Examples of suitable anionic groups, i.e. groups that are anionic or rendered anionic in water, Include phosphate, phosphonate, sulfate, sulfonate, sulphonic acid and carboxylic acid groups and salts thereof, usually ammonium or alkali metal (generally sodium) salts. The anionic groups can be native or introduced by means of chemical modification in known manner. The anionic stabilizer can have a degree of anionic substitution ($DS_A$) varying over a wide range; the $DS_A$ can be from 0.01 to 1.4, suitably from 0.1 to 1.2 and preferably from 0.2 to 1.0. Anionic polyelectrolytes may contain one or more cationic groups as long as it has an overall anionic charge.

In a preferred embodiment, the anionic stabilizer is selected from organic compounds. Suitable anionic stabilizers of this type include polymeric compounds such as those based on lignin or polysaccharides like starches, guar gums, celluloses, chitins, chitosans, glycans, galactans, glucans, xanthan gums, mannans, dextrins, etc., preferably phosphated, sulphonated and carboxylated lignin or polysaccharides, as well as synthethic organic polymers like condensation products, e.g. anionic polyurethanes and polymeric anionic compounds based on naphthalene, e.g. condensated naphthalene sulfonates, and further vinyl addition polymers formed from monomers with anionic groups, e.g. acrylic acid, methacylic acid, maleic acid, itaconic acid, crotonic acid, vinylsulfonic acid, sulfonated styrene and phosphates of hydroxyalkyl acrylates and methacrylates, optionally copolymerized with non-ionic monomers including acrylamide, alkyl acrylates, styrene and acrylonitrile as well as derivatives of such monomers, vinyl esters, and the like. Particularly preferred organic anionic stabilizers include anionic polysaccharides, e.g. cellulose-derivatives like carboxymethyl celluloses, condensated naphthalene or lignin sulfonates, anionic acrylamide-based polymers and polymers based on acrylic acid and similar acid monomers.

In one embodiment of the invention, the anionic stabilizer is hydrophobically-modified and contains one or more hydrophobic groups, suitably being a hydrophobically modified poly-saccharide, preferably carboxymethyl cellulose. Examples of suitable groups include hydrophobic substituents containing from 4 to about 30 carbon atoms, notably hydrophobic amide, ester and ether substituents comprising a saturated or unsaturated hydrocarbon chain of at least 4 and preferably from 8 to 30 carbon atoms, optionally being interrupted by one or more heteroatoms, e.g. oxygen or nitrogen, and/or groups containing a heteroatom, e.g. carbonyl or acyloxy.

In the case the anionic stabilizer is an organic compound or polymer, its weight average molecular weight is preferably above about 200 most preferably above 500, but is preferably below 50000.

In another embodiment, the anionic stabilizer is selected from inorganic anionic materials, preferably anionic inorganic polyelectrolytes such as, for example, compounds containing silicon atoms, e.g. various forms of condensated or polymerized silicic acid which have negative hydroxyl groups, e.g. oligomeric silicic acid, polysilicic acid, polysilicates and polyaluminiumsilicates.

The anionic stabilizer can also be selected from microparticulate material where both organic and inorganic anionic materials are encompassed. Suitable particulate materials of this type include highly cross-linked anionic vinyl addition polymers, e.g. acrylamide-based and acrylate-based polymers, anionic condensation polymers, e.g. melamine-sulfonic acid sols, inorganic silica-based materials, e.g. materials of the type present in aqueous silica-based sols like silica sols, aluminated silica sols, aluminiumsilicate sols, polysilicate microgels and polyaluminiumsilicate microgels, as well as silica gels and precipitated silica. The microparticulate material preferably is colloidal, i.e. in the colloidal range of particle size. The colloidal particles suitably have a particle size from about 1 nm to about 40 nm, preferably from 2 to 35 nm and most preferably from 2 to 10 nm.

A cellulose non-reactive sizing agent is preferably present in the dispersion in an amount from about 0.1 to about 50 wt %, most preferably from about 0.5 to about 50 wt %. Suitable cellulose non-reactive sizing agents are polymeric materials preferably having a weight average molecular weight greater than 50000, most preferably from 50000 up to about 1000000. Preferably the polymeric material is made from ethylenically unsaturated monomers.

Particularly suitable polymers include copolymers of styrene or substituted styrenes with at least one other kind of ethylenically unsaturated monomers, preferably comprising monomers containing one or more carboxyl groups. Examples of such monomers include maleic anhydride, acrylic acid, methacrylic acid and itaconic acid, as well as esters, amides and nitrile thereof, of which esters are particularly preferred. Preferred esters are alkyl esters where the alkyl group preferably have from 1 to 12 carbon atoms, most preferably from 1 to 5 carbon atoms. Particularly preferred are esters of acrylic acid or methacrylic acid. Examples of suitable alkyl groups are methyl, ethyl, propyl, n-butyl, isobutyl, tert-butyl and 2-butyl. A mixture at least two isomeric butyl acrylates or methacrylates, such as n-butyl- and t-butyl acrylate or methacrylate, is particularly preferred. The monomers as described above may also be co-polymerised with other ethylenically unsaturated monomers.

In a preferred embodiment the cellulose non-reactive sizing agent is a co-polymer obtained from ethylenically unsaturated monomers comprising from about 20 to about 80 wt %, preferably from about 30 to about 70 wt % of styrene or substituted styrene, from about 20 to about 80 wt %, preferably from about 30 to about 70 wt % of alkyl acrylate or methacrylate, and from 0 to about 15 wt %, preferably from 0 to about 10 wt % of other ethylenically unsaturated monomers.

The dispersion of the invention may also comprise other components, such as one or more of biocides, defoamers, inorganic compounds like aluminium or zirconium compounds, etc.

The dispersion of the invention is preferably predominantly anionic, which reduces the risk for interference with anionic components used in paper making. The pH is preferably from about 2 to about 6, most preferably from about 3 to about 5, which improves the stability of e.g. ketene dimers. The viscosity is preferably from about 1 to about 300 mPas, most preferably from about 5 to about 100 mPas. The dry content is preferably from about 1 to about 50 wt %, most preferably from about 5 to about 40 wt %.

It has been found possible to provide a dispersion of the invention with low viscosity and where both the static storage stability and the thermal stability are excellent. Furthermore, the dispersion of the invention has been found very efficient both for internal sizing and surface sizing at paper making.

The term "papers", as used herein, is meant to include not only ordinary paper but all types of cellulose-based products in sheet or web form, including, for example, board and paperboard. However, the invention is particularly advantageous for preparation of graphic paper to be used in all kinds of printing processes, such as ink-jet printing, laser printing, copying, etc.

The invention also concerns a process for the preparation of a dispersion as described above. The process comprises the steps of bringing together at least one cellulose reactive sizing agent selected from the group consisting of ketene dimers, and multimers, at least one cellulose non-reactive sizing agent, and at least one emulsifier selected from the group consisting of oxyalkylene phosphate and sulfate esters and salts thereof, in the presence of water to obtain a mixture, and homogenizing the mixture to obtain an aqueous dispersion. The temperature during the homogenisation is preferably sufficiently high for the cellulose reactive sizing agent to be liquid, and is in most case preferably from about 20 to about 100° C., most preferably from about 50 to about 95° C. Preferably the cellulose non-reactive sizing agent is added in the form of an aqueous dispersion, for example a commercially available cellulose non-reactive size such as dispersions of poly (styrene/acrylate) marketed under the trademarks Jetsize® AE 27, AE 35 and AE 76 (Eka Chemicals AB), Basoplast® 400 DS (BASF), Perglutin® A 281 (Giulini), or a dispersion as described in U.S. Pat. No. 6,426,381. Further, it is preferred to, before the homogenisation, also add a cationic organic compound having a weight average molecular weight less than about 10000 or an anionic stabilizer, or both, which is most preferred. Regarding suitable and preferred variants of the components and amounts thereof, the above description of the dispersion as such is referred to.

The invention further concerns use of a dispersion according to the invention as described above for surface sizing of paper and a process for the production of paper comprising the steps of forming a paper web from a stock containing cellulosic fibers and applying to the surface of the paper web an aqueous dispersion according to the invention as described above. The dispersion may be applied to the paper web by all known methods in a size press or other suitable equipment and is preferably included in the size press liquor. Preferably a dispersion of the invention is supplied to the paper in an amount from about 0.05 to about 20 wt %, preferably from about 0.1 to about 10 wt %, based on amount of paper produced. It is further possible to supply with the size press liquor one or more of the following components: optical brightening agents, preferably in an amount from about 0 to about 2 wt % of amount of paper produced, pigments (e.g. chalk, precipitated calcium carbonate, kaolin, titanium dioxide, barium sulphate or gypsum), preferably in an amount from about 0 to about 15 g/m$^2$ paper produced, starch, preferably in an amount from about 0 to about 5 g/m$^2$ paper produce, crosslinkers such as zirconium compounds, insolubilisers, defoamers, etc.

The invention furthermore concerns use of a dispersion according to the invention as described above for internal sizing at production of paper and a process for the production of paper comprising the steps of adding a dispersion according to the invention as described above to a stock containing cellulosic fibers, and dewatering the stock on a wire to obtain paper and white water. The dispersion may be added separately or be premixed with one or more other additive, such as a retention aid.

The stock preferably contains from about 50 to about 100 wt %, most preferably from about 70 to about 100 wt % of cellulosic fibers, based on dry stock. Preferably the stock also contains one or more fillers, e.g. mineral fillers like kaolin, china clay, titanium dioxide, gypsum, talc, chalk, ground marble or precipitated calcium carbonate, and optionally other commonly used additives, such as retention aids, aluminium compounds, dyes, wet-strength resins, optical brightening agents, etc. Examples of aluminium compounds include alum, aluminates and polyaluminium compounds, e.g. polyaluminium chlorides and sulphates. Examples of retention aids include cationic polymers, anionic inorganic materials In combination with organic polymers, e.g. bentonite in combination with cationic polymers, silica-based sols in combination with cationic polymers or cationic and anionic polymers.

A dispersion of the invention is preferably added to the stock and/or the paper web in an amount so the total amount of cellulose reactive sizing agent added is from about 0.01 to about 10 wt %, most preferably from about 0.03 to about 5 wt % of the paper produced, while the total amount of cellulose non-reactive sizing agent added preferably is from about 0.01 to about 10 wt %, most preferably from about 0.03 to about 5 wt % of the paper produced. The exact amounts depend on the quality of the pulp and the level of sizing desired.

It has been found that by using the dispersion of the invention the sizing effect compared to use of conventional sizes is improved at a corresponding doses of cellulose reactive sizing agent. The possibility of using lower amounts of sizing agent to achieve a desired level of sizing reduces the risk of accumulation of non-adsorbed sizing agents in the white water recirculating in the process, thereby reducing the risk of aggregation and deposition of the sizing agents on the paper machine. Thus, the invention is particularly advantageous in processes with high degree of white water closure, for example where from 0 to 30 tonnes, usually less than 20 tonnes, suitably less than 15 tonnes, preferably less than 10 tonnes and most preferably less than 5 tonnes of fresh water are used per ton of dry paper produced. Besides, the invention gives a fast on-machine sizing and a very uniform sizing. Furthermore, the dispersion does not interfere significantly with strong anionic components present in the papermaking process, and does therefore not reduce the efficiency of, for example, optical brightening agents.

The invention will now be further described in connections with the following Examples which, however, do not intend to limit the scope thereof. Unless otherwise stated, all parts and percentages refer to parts and percent by weight

EXAMPLE 1

An anionic aqueous sizing dispersion according to the invention was prepared from the following formulation for 1 kg dispersion:

60 g AKD (alkyl ketene dimer) (Keywax® SF100, Eka Chemicals)

115 g aqueous dispersion of poly (styrene/acrylic ester) (Jetsize® AE 76, Eka Chemicals)

2.75 g ditallow dimethyl ammonium chloride (Arquad™ 2HT-75PG, Akzo Nobel)

4.5 g polyoxyethylene phosphate ester (Rhodafac™ RS-710, Rhodia)

3.6 g condensated sodium naphthalene sulfonate formaldehyde condensate (Orotan™ SN Rohm & Haas Company)

balance up to 1000 g: water

The ditallow dimethyl ammoniumchloride was mixed with molten alkyl ketene dimer at 70° C. and the mixture was passed through a homogenizer in the presence of the dispersion of poly (styrene/acrylic ester), which was pre-blended with the polyoxyethylene phosphate ester and the condensated sodium naphthalene sulfonate.

The dispersion was used for internal sizing in a pilot plant paper machine producing paper from fine paper furnish with 15% ground calcium carbonate (Hydrocarb™ 50BG GCC, Omya) and 0.6% optical brightening agent. The retention system used was 0.5% cationic potato starch (Hi-Cat™ 142, Roquette) and 0.3% anionic silica sol (Eka™ NP 442, Eka Chemicals). For comparison, paper was produced under the same conditions but sized with a standard AKD dispersion Keydime® C (Eka Chemicals). The papers were tested in respect of water absorption according to Cobb 60 (Tappi test method T 441 om-90) and ink resistance according to HST 80 (Tappi test method T 530 pm-89). The results are shown in the table below:

| Product | Keydime ® C | | | Invention Example 1 | | |
|---|---|---|---|---|---|---|
| AKD dosage (kg/t paper) | 0.5 | 0.7 | 0.9 | 0.5 | 0.7 | 0.9 |
| Cobb 60 ($g/m^2$) | 33 | 24 | 22 | 26 | 22 | 21 |
| HST 80 (seconds) | 104 | 302 | 378 | 192 | 348 | 470 |

It appears that the dispersion of the invention gives considerably improved sizing than the conventional AKD based size.

EXAMPLE 2

A dispersion of the invention was prepared in the same way as in Example 1 from 30 g Keywax™ SF100, 200 g Jetsize® AE 76, 4.8 g Arquad™ 2HT-75PG, 6.3 g Rhodafac™ RS-710, 6.3 g Orotan™ SN and water to 1000 g. The dispersion was used for surface sizing of an internally pre-sized paper (Cobb 60=37 $g/m^2$) produced from fine paper furnish containing 18% ground calcium carbonate (Hydrocarb™ 50 BG; GCC Omya) and with ASA (Lasar® 220, Eka Chemicals) as internal sizing agent in an amount of 0.75 kg per tonne paper. The basis weight was 80 $g/m^2$. The retention system was 0.5% cationic potato starch (Hi-Cat™ 142, Roquette) and 0.5%, anionic silica sol (Eka™ NP 780, Eka Chemicals). Additionally 0.6% optical brightening agent was added to the stock. The dispersion of the invention was added in the size press together with oxidised potato starch (Perfectamyl™ P 255 SH, Avebe) at 5% solids content. For comparison, the same kind of paper was surface sized under the same conditions with a standard surface size based on a styrene acrylate co-polymer dispersion (Jetsize® AE 76, Eka Chemicals). The papers were tested in respect of water absorption according to Cobb 60 and ink resistance according to HST 80. The results are shown in the table below:

| Product | Jetsize ® AE 76 | | | | Invention Example 2 | | | |
|---|---|---|---|---|---|---|---|---|
| Dosage (% active components* of produced paper) | 0.025 | 0.035 | 0.05 | 0.085 | 0.01 | 0.02 | 0.03 | 0.04 |
| Cobb 60 ($g/m^2$) | 33 | 32.1 | 30.4 | 24.8 | 36.2 | 25 | 22.8 | 22.1 |
| HST 80 (seconds) | 89 | 91 | 119 | 161 | 67 | 148 | 171 | 208 |

*Active components refer to the total amount of alkyl ketene dimers and styrene acrylate copolymer It appears that the dispersion of the invention gives considerably improved sizing than the conventional surface size.

EXAMPLE 3

Dispersion were prepared in the same way as in Example 1 and the static storage stability was tested by storing the samples in bottles for five weeks and then measuring the dry content at the top and the bottom of the bottles. The formulations (for 1 kg dispersion) and the results are shown in the table below:

| Formulation | (a) | (b) | (c) | (d) |
|---|---|---|---|---|
| Keywax ® SF 100 (g) | 60 | 60 | 60 | 60 |
| Jetsize ® AE 76 (g) | 86 | 86 | 86 | 86 |
| Arquad ™ 2HT-75PG (g) | 2.75 | 2.75 | 2.75 | 2.75 |
| Rhodafac ™ RS-710 (g) | — | 0.7 | 3.6 | 6.7 |
| Orotan ™ SN (g) | 3.6 | 3.6 | 3.6 | 3.6 |
| water | balance | balance | balance | balance |
| Dry content on top after 5 weeks (%) | Separated into two phases | 10.3 | 10.8 | 11.2 |
| Dry content at bottom after 5 weeks (%) | Separated into two phases | 6.0 | 10.3 | 11.1 |

It appears that the sample without the polyoxyethylene phosphate ester had separated into two phases already after five weeks of storage.

EXAMPLE 4

Dispersions were prepared in the same way as in Example 1 and the thermal stability was tested by shaking the samples 10 days at 250 rpm and 30° C. and measuring the particle size distribution. The formulations (for 1 kg dispersion) and the results are shown in the table below. The figures for particle size refer the particle size 50% and 90% by volume, respectively, of the particles in each sample are smaller than. Thus, in Formulation (1) after 10 days 50% of the particles were smaller than 0.59 μm and 90% smaller than 0.92 μm.

| Formulation | (1) | (2) | (3) | (4) | (5) |
|---|---|---|---|---|---|
| Keywax ® SF 100 (g) | 60 | 60 | 60 | 60 | 60 |
| Jetsize ® AE 76 (g) | 115 | 115 | 115 | 115 | 115 |
| Arquad ™ 2HT-75PG (g) | 2.75 | 5.5 | 1.375 | 2.75 | 2.75 |
| Rhodafac ™ RS-710 (g) | 3.6 | 3.6 | 3.6 | 3.6 | 3.6 |
| Orotan ™ SN (g) | 3.6 | 3.6 | 3.6 | 7.2 | 1.85 |
| water | balance | balance | balance | balance | balance |
| Initial Particle size 50%/90% (μM) | 0.56/0.85 | 0.64/1.47 | 0.53/0.86 | 0.58/0.95 | 0.61/1.05 |
| Particle size after 7 days 50%/90% (μm) | 0.59/0.97 | 14.8/27.0 | 0.51/0.71 | 0.71/3.62 | 13.8/25.5 |
| Particle size after 10 days 50%/90% (μm) | 0.59/0.92 | 14.7/25.0 | 0.68/16.1 | 0.72/16.9 | 14.2/24.4 |

The invention claimed is:

1. Aqueous dispersion useful for internal sizing or surface sizing in the production of paper, comprising at least one cellulose reactive sizing agent selected from the group consisting of ketene dimers and multimers, at least one cellulose non-reactive sizing agent selected from the group consisting of copolymers of styrene or substituted styrene with at least one other kind of ethylenically unsaturated monomers, at least one emulsifier selected from the group consisting of oxyalkylene phosphate esters and salts thereof, at least one cationic organic compound having a weight average molecular weight less than about 10000 and a condensated naphthalene sulfonate anionic stabilizer, wherein the cationic organic compound is a surfactant selected from the group consisting compounds having the general formula $R_4N^+X^-$, where each R group, independently of each other, is hydrogen or a hydrocarbon group having from 1 to 30 carbon atoms, and X is an anion, and wherein the dispersion is predominantly anionic, and wherein said at least one emulsifier is present in an amount from 0.01 to 5 wt %, said surfactant is present in an amount from 0.1 to 0.55 wt % and said anionic stabilizer is present in an amount from 0.185 to 3 wt %, based on the dispersion, and wherein said anionic stabilizer is present in an amount greater than said surfactant, and wherein the oxyalkylene phosphate esters are of the formula:

$$R^3\text{-}A^1\text{-}O\text{-}Q\text{-}R^4$$

where $R^4$ is —OH or —O-$A^2$-$R^5$;

$A^1$ and $A^2$, independently of each other, are oxyalkylene chains with from 2 to 100 oxyalkylene units;

Q is PO(OH); and, $R^3$ and $R^5$, independently of each other, are hydrocarbon groups having from 3 to 50 carbon atoms.

2. Dispersion as claimed in claim 1 wherein the pH is from about 2 to about 6.

3. A process for the production of paper comprising the steps of forming a paper web from a stock containing cellulosic fibers and applying to the surface of the paper web an aqueous dispersion according to claim 1.

4. A process for the production of paper comprising the steps of adding to a stock containing cellulosic fibers a dispersion according to claim 1, and dewatering the stock on a wire to obtain paper and white water.

5. Dispersion as claimed in claim 1, wherein said emulsifier is present in an amount sufficient to provide the dispersion with a static storage stability of at least 5 weeks.

6. Dispersion as claimed in claim 1, wherein said at least one other kind of ethylenically unsaturated monomers are selected from the group consisting of alkyl esters of acrylic acid or methacrylic acid.

7. Dispersion as claimed in claim 1, wherein the at least one cellulose non-reactive sizing agent copolymer has a weight average molecular weight greater than 50,000.

8. Dispersion as claimed in claim 2, wherein the pH of the dispersion is from about 2 to about 5.

* * * * *